United States Patent [19]

Dickinson et al.

[11] Patent Number: 4,749,337

[45] Date of Patent: Jun. 7, 1988

[54] RECIPROCATING BLADDER PUMP, AND METHODS OF CONSTRUCTING AND UTILIZING SAME

[75] Inventors: W. David Dickinson; James Mirand, both of Medina, N.Y.

[73] Assignee: American Sigma, Inc., Middleport, N.Y.

[21] Appl. No.: 87,216

[22] Filed: Aug. 20, 1987

[51] Int. Cl.[4] ..... F04B 43/06

[52] U.S. Cl. ..... 417/199.1; 417/374; 417/394; 417/478

[58] Field of Search ..... 417/394, 478, 479, 374, 417/199

[56] References Cited

U.S. PATENT DOCUMENTS 4,489,779 12/1984 Dickinson ..... 166/64
4,701,107 10/1987 Dickinson ..... 417/478 X

FOREIGN PATENT DOCUMENTS 349431 5/1931 United Kingdom ..... 417/394

*Primary Examiner*—Leonard E. Smith
*Attorney, Agent, or Firm*—Irving M. Weiner; Joseph P. Carrier; Pamela Burt

[57] ABSTRACT

A two-stage combination reciprocating and bladder pump wherein a hollow piston is disposed for reciprocating movement within a main pump body, and a bladder pump is housed in the piston. The piston pump and bladder pump are thus coaxially arranged, with the bladder pump mounted within the piston pump and operably cooperating therewith. A reciprocating tube is attached to the piston to permit operation thereof from above ground, and also serves as a conduit for alternately supplying pressurized air and atmospheric venting to the bladder pump. A rigid support pipe supports the main pump body, and has the reciprocating tube extending coaxially therethrough. A fluid discharge tube is in turn coaxially arranged within the reciprocating tube, thus defining a triaxial tubular arrangement. The fluid discharge tube provides communication between a fluid chamber of the piston pump and a fluid chamber of the bladder pump, and also functions as a conduit for discharging fluid to the exterior of the main pump body. The piston pump operates to discharge fluid at a relatively high speed for purging operation, while the bladder pump is selectively actuated to discharge fluid at a relatively low speed for representative water sampling.

20 Claims, 1 Drawing Sheet

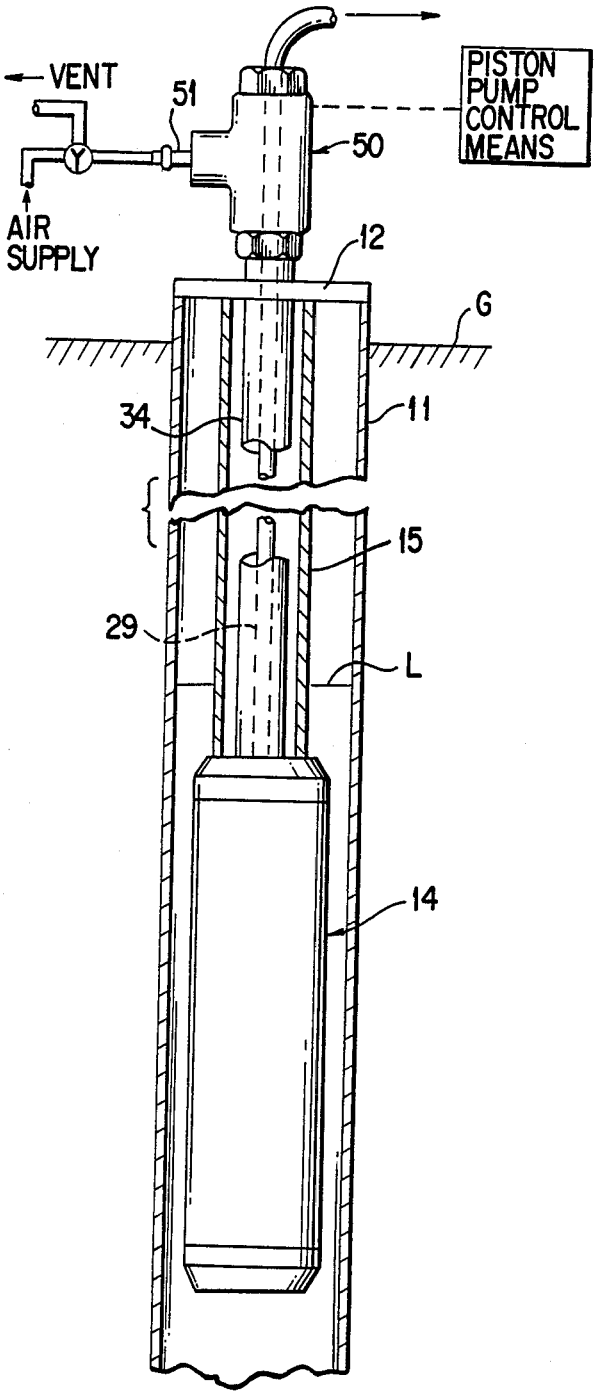
FIG.1
FIG.2
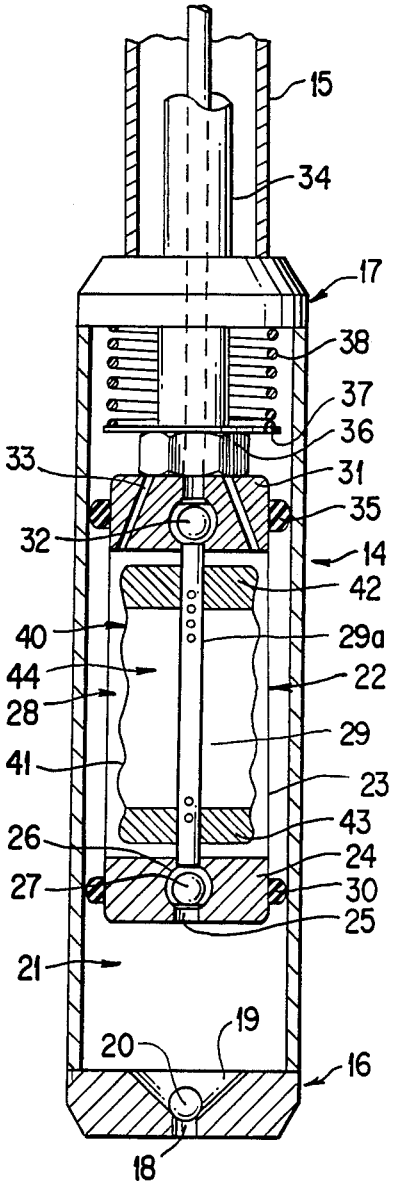

RECIPROCATING BLADDER PUMP, AND METHODS OF CONSTRUCTING AND UTILIZING SAME

BACKGROUND OF THE INVENTION

1. Field of the Invention

The present invention relates generally to a fluid sampling device which may be used to obtain, for example, ground water samples from a well. More particularly, the invention relates to a combination two-stage pump device which includes both a reciprocating (piston) pump for purging water prior to sampling, and a bladder pump for withdrawing actual samples.

2. Description of the Relevant Art

Ground water contamination has become a primary area of environmental concern, resulting in a disideratum for efficient equipment for withdrawing water samples from monitoring wells so that it may be chemically analyzed. Such sampling equipment must not only comply with governmental restrictions; it should also be time, energy and cost efficient.

One set of conflicting demands which arises is that whereas governmental restrictions require that a bladder-type pump be used to obtain the most representative well water sample for analysis, this type of pump is highly inefficient for necessary initial purging operations due to its relatively slow pumping speed.

Prior arrangements have relied upon the use of both a bladder pump for obtaining samples; and a second pump, such as an air lift pump, for initial purging operations. Such arrangements require separate mounting of the bladder and air lift pumps, which results in increased costs for producing and controlling the two pumps separately. In the case where two such pumps are mounted side-by-side in a well casing, the diameter of the associated well casing must be large enough to accommodate same. Further, separate provisions must in any case be made for extending the lengths of the fittings for each pump when the monitoring well is very deep.

In applicant's prior U.S. Pat. No. 4,701,107 filed Apr. 4, 1986, there is disclosed a two-stage pump sampler device which fulfills the above-described desideratum by combining an air lift and bladder pump into a two-stage single pumpd. The two pumps are coaxially arranged in a single casing to permit independent initial purging by the air lift pump, and subsequent water sampling by the bladder pump.

It is an object of the present invention to provide a novel two-stage pump sampler device which also fulfills the aforesaid desideratum, and which does so by combining a reciprocating (piston) pump and a bladder pump in a single coaxial arrangement. The two pumps are independently operable to permit efficient initial purging by the piston pump, and subsequent representative water sampling by the bladder pump.

The two-stage pump sampler device according to the present invention also eliminates any need for vacuum in the bladder pump operation, and prevents the water sample from being exposed to negative pressure or air.

By virtue of its novel two-stage pump arrangement, the device according to the present invention may be employed in relatively small-diameter well casings in comparison with other known samplers, is readily extensible to accommodate various well depths, and is relatively simple and inexpensive to manufacture.

SUMMARY OF THE INVENTION

According to a preferred embodiment of the invention, there is provided a two-stage pump which includes a substantially hollow piston disposed for reciprocating movement within a main pump body, the piston having a bladder pump housed therein. A first valve means is disposed at a lower end of the main pump body to permit unidirectional fluid flow from the exterior of the main pump body to a lower fluid chamber defined in a lower portion of the main pump body below the piston. A second valve means is disposed at a lower end of the piston to permit unidirectional fluid flow from the lower fluid chamber to a fluid discharge tube. The fluid discharge tube communicates with the bladder pump to permit fluid supply thereto, and extends to the exterior of the main pump body through a third valve means disposed at an upper end of the piston, the third valve means being adapted to permit unidirectional fluid flow upwardly therethrough. Means are provided for alternately supplying pressurized air and atmospheric venting to the bladder pump. Further, the piston is selectively actuated by piston pump control means to pump fluid from the lower fluid chamber through the fluid discharge tube at a relatively high speed. The bladder pump is selectively actuated by the means for alternately supplying pressurized air and atmospheric venting to pump fluid through the fluid discharge tube at a relatively low speed.

In the preferred embodiment, a reciprocating tube which reciprocates with the piston is fixed to an upper end of the piston and extends coaxially through a rigid support pipe fixed to the upper end of the main pump housing and supporting same from a support member. The fluid discharge tube in turn extends coaxially through the reciprocating tube, thus defining a triaxial tubular arrangement.

It is an object of the invention to provide a two-stage pump having both a piston pump operational mode and a bladder pump operational mode. When the two-stage pump is in its piston pump operational mode, water is pumped at a relatively high speed to permit expeditious purging of stale water from a well. When the two-stage pump is in its bladder pump operational mode, water is pumped at a relatively low speed so that the most representative water samples can be obtained.

The above and further objects, details and advantages of the invention will become apparent from the following detailed description, when read in conjunction with the accompanying drawings.

BRIEF DESCRIPTION OF THE DRAWINGS

FIG. 1 is an elevational view illustrating a two-stage reciprocating bladder pump according to a preferred embodiment of the invention, as it appears when mounted in a well casing.

FIG. 2 is an enlarged sectional view showing the coaxial pump arrangement of the two-stage pump of FIG. 1.

DETAILED DESCRIPTION OF PREFERRED EMBODIMENTS

With reference to FIG. 1, there is shown a novel two-stage reciprocating bladder pump according to the invention as mounted in the well casing 11 of a conventional monitoring well. A well cap 12 is mounted on the top end of casing 11 slightly above the ground surface G. In use, the pump is disposed such that the main pump body 14 is submerged, i.e., it is disposed below the water level L within well casing 11 as shown in FIG. 1.

The main pump body 14 is supported at its upper end by a rigid support pipe 15 extending downwardly from well cap 12. As shown in FIG. 2, main pump body 14 is closed at its lower end by a check valve housing 16, and at its upper end by a closure 17 having an inner surface defining a spring seat as will be described hereinbelow.

As shown in FIG. 2, the valve housing 16 has in its lower end a central fluid inlet port 18 communicating with a coaxial enlarged bore 19. Mounted for limited movement in the bore 19 is a ball or check valve 20 having a larger diameter than the diameter of port 18. Valve 20 is retained in bore 19 by horizontal rods or similar member(s) which extend across the upper end of bore 19 without preventing fluid flow therethrough. Thus, when valve 20 is unseated or in the open position, water is free to flow through port 18 and bore 19 to the interior of a lower fluid (water) chamber 21.

Mounted for reciprocating movement within the main pump body 14 is a piston 22 defined by a cylindrical body 23 which is substantially closed at its lower end by a valve housing 24. A lower central fluid inlet port 25 communicating with an enlarged opening 26 provides fluid communcation between lower fluid chamber 21 and a water discharge tube 29 when a ball or check valve 27, mounted for limited movement in the opening 26, is in an unseated or open position. The check valve 27 comprises a lower bladder pump check valve, and its operation will be described in greater detail hereinbelow.

Extending circumferentially around valve housing 24 is an O-ring seal 30 which defines a dynamic seal between the inner wall of main pump body 14 and the outer wall of valve housing 24 when piston 22 reciprocates within main pump body 14. The upper end of cylindrical body 23 of piston 22 is substantially closed by a valve housing 31. The water discharge tube 29 extends into a bore centrally provided in the lower end of valve housing 31, and communicates with an enlarged opening which accommodates a ball or check valve 32. Valve 32 is mounted for axial movement between the lower valve seat defined at the opening of discharge tube 29 and an upper horizontal member(s) extending transversely across the upper end of the enlarged opening. The check valve 32 comprises an upper bladder check valve which operates in a manner to be described in detail hereinbelow.

Extending upwardly from the enlarged opening containing check valve 32 and through an upper bore in housing 31 is a continuation of water discharge tube 29, which as shown in FIG. 1, extends upwardly to above the ground surface. Also provided in valve housing 31 are diagonally extending ports 33 which communicate between a fluid (air) chamber 28 defined within piston 22 and a reciprocating tube 34 attached by a nut 36 to an upper portion of valve housing 31. As will be understood from the description set forth below, the reciprocating tube 34 reciprocates together with piston 22 during purging operation of the two-stage pump according to the invention.

As will be understood from the foregoing, and as shown in FIGS. 1 and 2, the upper portion of water discharge tube 29 is disposed coaxially within reciprocating tube 34, which is in turn disposed coaxially within rigid support pipe 15, thus defining a triaxial arrangement of the three cylindrical members. A centralizer seal, in the form of an O-ring, is disposed circumferentially around valve housing 31 so as to slidingly engage the inner surface of main pump body 14. Arranged between a lower spring seat 37 supported by nut 36 and an upper spring seat defined by the inner surface of closure 17 is a spring 38 which assists in reciprocating the piston 22 as will be described hereinbelow.

The piston 22 and its associated structure comprises the piston pump for purging operation of the two-stage pump according to the invention, and houses within cylindrical body 23 a bladder pump structure for sampling operation of the two-stage pump, as described below.

A bladder cartridge 40 including a flexible tubular bladder 41 and upper and lower retainers 42 and 43 which support the bladder 41 coaxially about the lower portion of water discharge tube 29, is disposed within cylindrical body 23 of piston 22. The cylindrical body 23 and valve housings 24 and 31 thus define an inner pump housing for the bladder pump. A plurality of longitudinally-spaced perforations 29*a* are provided in water discharge tube 29 in communication with a fluid (water) chamber 44 defined within bladder cartridge 40. The air chamber 28 is defined outside of bladder cartridge 40 within cylindrical body 23 of piston 22.

As shown in FIG. 1, both the reciprocating tube 34 and the water discharge tube 29 extend upwardly through an opening provided in well cap 12. A pump splitter member 50 has secured at the lower end thereof the upper end of reciprocating tube 34, while water discharge tube 29 extends therethrough and out of the upper end thereof. The pump splitter 50 has a T-configuration or other suitable configuration to permit branching off of an air fitting 51 which in turn is branched via a suitable supply valve means for selective communication with an atmospheric vent means or a source of compressed air.

The pump splitter 50 is shown in FIG. 1 as being under the control of a piston pump control means. It will be understood that such control means is intended to represent either a manual operation of pump splitter 50 so as to in turn reciprocate the reciprocating tube 34 and piston 22, or any suitable conventional pneumatic, electric, hydraulic, or other means for effecting such reciprocation.

The novel structure and functional features of the two-stage reciprocating bladder pump according to the invention will become more apparent from the following detailed description of the operation thereof.

In use, the two-stage reciprocating bladder pump according to the invention is inserted into well casing 11 to a sufficient depth such that the main pump body 14 is completely immersed in the water (or other fluid) as shown in FIG. 1, with rigid support pipe 15 supported by well cap 12. At this time, water will enter water chamber 21 through inlet port 18 and open check valve 20 until water chamber 21 is substantially filled. Next, when piston 22 is pushed down, either by manual or automatic operation, the water in chamber 21 will be forced upwardly to open lower bladder check valve 27. The water will continue its upward flow through water discharge tube 29, causing upper bladder check valve 32 to open and permitting the water to be discharged upwardly through the above-ground end of water discharge tube 29.

It will be understood that during such downstroke operation of the piston pump, the reciprocating tube 34 reciprocates together with piston 22. The same is true during upstroke movement of piston 22. Also, it will be apparent that during downstroke operation of the piston pump, the spring 38 will provide assistance by virtue of the downward urging force which it normally applies to piston 22.

Once piston 22 has moved its full downward stroke so that it is adjacent check valve housing 16, it is then moved upwardly to refill water chamber 21. During upstroke movement, both bladder check valves 27 and 32 will close, while the main body check valve 20 will open to permit free fluid flow into water chamber 21.

Reciprocating operation of the piston pump as described above is continued until the purging operation is complete, i.e., until stale water has been removed from the well, with water being pumped at a relatively high speed.

When it is desired to switch to the second stage of pump operation, i.e., for obtaining fluid samples, the bladder pump portion of the reciprocating bladder pump is actuated. To this end, the above-ground supply valve shown in FIG. 1 is switched into an air supply mode in which compressed air is supplied through air fitting 51 and pump splitter 50 to the reciprocating tube 34. The pressurized air will flow through the ports 33 to air chamber 28 surrounding bladder cartridge 40. Flexible bladder 41 will thus be contracted to expel ground water from the bladder water chamber 44 which has entered same through perforations 29a in discharge tube 29.

Next, the supply valve is switched to its venting mode, permitting reciprocating tube 34 to be vented to the open atmosphere and allowing water to again flow into the bladder water chamber 44 through perforations **29*a* under the influence of natural hydrostatic pressure. The supply valve is automatically alternated between pressurization and venting conditions by any suitable means, such as a pneumatic timing circuit, so that flexible bladder 41** is alternately contracted and expanded.

This pumping operation of bladder 41 causes water alternately to be drawn upwardly through the lower check valve housing 16 and perforations **29*a* in tube 29 to the water chamber 44 as the bladder expands; and then to be forced out of chamber 44 through the perforations 29*a* into tube 29, and because check valve 27 is now forced to its closed position, to be forced upwardly through open check valve 32** for sample output.

In the foregoing second stage or bladder pump stage, the combination reciprocating bladder pump operates to obtain water samples at a relatively slow rate of speed in kepeing with governmental restrictions for a most representative ground water sample.

From the above it will be apparent that the present invention provides a simple, inexpensive and efficient two-stage combination reciprocating bladder pump which eliminates the need for employing two separate purging and sampling pumps. At the same time, the invention ensures that the water samples will not be exposed to negative pressure or air.

It will also be understood that the triaxial tube arrangement of the invention can be adapted to varying lengths so as to accommodate monitoring wells of varying depths.

Also, as noted hereinabove, although the piston pump operational mode can be readily controlled by automatic means such as a pneumatic power source, the piston pump can also be readily pumped by hand if desired. It should further be understood that the bladder pump arrangement shown herein can readily be modified without departing from the invention.

While there have been described what are at present considered to be the preferred embodiments of the invention, it will be understood that many changes and modifications may be made therein without departing from the scope of the appended claims.

We claim:

1. A two-stage pump, comprising:

a main pump body having a first check valve in one end thereof disposed to be immersed in a supply of liquid;

an inner pump housing mounted in said main pump body in spaced relation thereto, and having second and third check valves respectively mounted in opposite ends thereof;

a movable fluid-operated bladder pumping element disposed in said inner pump housing so as to divide the interior thereof into inner and outer chambers;

said inner pump housing defining a piston adapted for sliding movement within said main pump body;

said first check valve being operable to permit liquid to flow unidirectionally therethrough from said supply to a lower fluid chamber defined within the lower portion of said main pump body below said piston;

a first conduit connecting said lower fluid chamber of said main pump body to the exterior of said main pump body, successively through said second check valve, said inner chamber and said third check valve;

a second conduit connecting said outer chamber of said inner pump housing to a supply of fluid under pressure for use in forcing liquid from said inner chamber of said inner pump housing, through said first conduit, and through said third check valve to the exterior of said main pump body; and means for supporting said main pump body.

2. A two-stage pump according to claim 1, wherein:

a lower portion of said piston has a circumferential sealing member disposed therearound which sealingly contacts the inner wall of said main pump body to define a dynamic seal.

3. A two-stage pump according to claim 2, wherein:

a spring is mounted adjacent an upper portion of said piston to facilitate reciprocating movement of said piston.

4. A two-stage pump according to claim 2, wherein:

said bladder pumping element is adapted to contract when said pressurized fluid is supplied through said second conduit to said outer chamber, and to expand when said supply valve is switched to said venting mode.

5. A two-stage pump according to claim 1, wherein:

said second check valve is operable to permit liquid to flow unidirectionally therethrough from said lower fluid chamber to said first conduit;

said first conduit comprises a water discharge tube communicating at one end thereof with said second check valve, extending through said inner chamber, communicating with said third check valve, and extending to the exterior of said main pump body; and the portion of said water discharge tube extending through said inner chamber is provided with perforations communicating with said inner chamber.

6. A two-stage pump according to claim 2, wherein:

said second conduit is selectively connected through a supply valve to said supply of fluid under pressure;

said supply valve is further selectively connected to atmospheric venting means; and said supply valve is adapted to be switched between a venting mode and a pressurized air supply mode.

7. A two-stage pump according to claim 6, wherein:

said main pump body supporting means comprises a rigid support pipe extending from an upper end of said main pump body to a supporting member.

8. A two-stage pump according to claim 7, wherein:

said second conduit comprises a reciprocating tube adapted to reciprocate together with said piston.

9. A two-stage pump according to claim 8, wherein:

said second and third check valves are adapted to open during a downstroke movement of said piston to permit water to be discharged through said water discharge tube; and said first check valve is adapted to close during said downstroke movement of said piston.

10. A two-stage pump according to claim 9, wherein:

said first check valve is adapted to open during said upstroke movement of said piston to permit water to fill said lower fluid chamber.

11. A two-stage pump according to claim 8, wherein:

an upper portion of said water discharge tube extends coaxially through said reciprocating tube, and said reciprocating tube in turn extends coaxially through said rigid support pipe, thus defining a triaxial tubular arrangement.

12. A two-stage pump according to claim 5, further comprising:

a pump splitter element having an upper portion of said water discharge tube extending therethrough, an upper end of said reciprocating tube connected thereto, and said supply of fluid under pressure connected thereto; and said pump splitter element being adapted to be reciprocated so as to impart reciprocating movement to said reciprocating tube and in turn to said piston.

13. A two-stage combination reciprocating bladder pump, comprising:

a substantially hollow piston disposed for reciprocating movement within a main pump body;

a bladder pump housed within said piston;

first valve means disposed at a lower end of said main pump body to permit unidirectional fluid flow from the exterior of said main pump body to a lower fluid chamber defined in a lower portion of said main pump body below said piston;

second valve means disposed at a lower end of said piston to permit unidirectional fluid flow from said lower fluid chamber to a fluid discharge tube;

said fluid discharge tube communicating with said bladder pump to permit fluid supply thereto, and extending to the exterior of said main pump body through third valve means disposed at an upper end of said piston, said third valve means being adapted to permit unidirectional fluid flow upwardly therethrough;

means for alternately supplying pressurized air and atmospheric venting to said bladder pump;

said piston being selectively actuated by piston pump control means to pump fluid from said lower fluid chamber through said fluid discharge tube at a relatively high speed; and said bladder pump being selectively actuated by said means for alternately supplying pressurized air and atmospheric venting to pump fluid through said fluid discharge tube at a relatively low speed.

14. A two-stage combination reciprocating bladder pump according to claim 13, wherein:

said first valve means comprises a first check valve adapted to close during a downstroke movement of said piston; and said second and third valve means comprise second and third check valves, respectively, said second and third check valves being adapted to open during said downstroke movement of said piston.

15. A two-stage combination reciprocating bladder pump according to claim 14, wherein:

said piston has a reciprocating tube connected to an upper end thereof and adapted to reciprocate therewith; and an upper portion of said fluid discharge tube is disposed coaxially within said reciprocating tube.

16. A two-stage combination reciprocating bladder pump according to claim 15, wherein:

said reciprocating tube comprises a conduit portion of said pressurized air and venting supply means; and said reciprocating tube is connected to said upper end of said piston and communicates through ports with said bladder pump.

17. A two-stage combination reciprocating bladder pump according to claim 16, wherein:

a rigid support pipe is attached at one end thereof to an upper end of said main pump body, and at the other end thereof to a support means; and said reciprocating tube having said fluid discharge tube disposed coaxially therein is itself coaxially disposed within said rigid support pipe.

18. A two-stage combination reciprocating bladder pump according to claim 13, wherein:

said bladder pump comprises:

an outer cylindrical portion defined by a cylindrical body portion of said piston;

a lower valve housing disposed at said lower end of said piston and having said second valve means mounted therein;

an upper valve housing disposed at said upper end of said piston and having said third valve means mounted therein; and a bladder cartridge supported by said fluid discharge tube.

19. A two-stage combination reciprocating bladder pump according to claim 18, wherein:

a portion of said fluid discharge tube is provided with a plurality of perforations adapted to permit said fluid supply to said bladder pump;

said bladder pump comprises a bladder cartridge including a flexible cylindrical bladder member; and said bladder cartridge is supported coaxially on said portion of said fluid discharge tube.

20. A two-stage combination reciprocating bladder pump according to claim 19, wherein:

said upper valve housing has a plurality of ports defined therethrough;

said piston has a reciprocating tube connected to an upper end thereof and adapted to reciprocate therewith;

an upper portion of said fluid discharge tube is disposed coaxially within said reciprocating tube;

said reciprocating tube comprises a conduit portion of said pressurized air and venting supply means; and said reciprocating tube is connected to said upper end of said piston and communicates through said plurality of ports with said bladder pump.

* * * * *

UNITED STATES PATENT AND TRADEMARK OFFICE

CERTIFICATE OF CORRECTION

PATENT NO. : 4,749,337

DATED : June 7, 1988

INVENTOR(S) : W. David Dickinson; James Mirand

It is certified that error appears in the above-identified patent and that said Letters Patent is hereby corrected as shown below:

Column 1, line 47, change "pumpd" to --pump--.

Column 5, line 49, change "kepeing" to --keeping--.

Column 6, line 46 (claim 4, line 1), change "2" to --6--.

Column 6, line 65 (claim 6, line 1), change "2" to --5--.

Column 7, line 5 (claim 7, line 1), change "6" to --5--.

Column 7, line 29 (claim 12, line 1), change "5" to --11--.

Signed and Sealed this

Twenty-first Day of February, 1989

*Attest:*

DONALD J. QUIGG

*Attesting Officer*

*Commissioner of Patents and Trademarks*